US006863111B1

(12) United States Patent
Chou

(10) Patent No.: US 6,863,111 B1
(45) Date of Patent: Mar. 8, 2005

(54) POSITIVE ENGAGEMENT END STOP FOR WINDOW COVERING SYSTEMS

(76) Inventor: Tser-Wen Chou, 19464 Via Del Caballo, Yorba Linda, CA (US) 92686

( * ) Notice: Subject to any disclaimer, the term of this patent is extended or adjusted under 35 U.S.C. 154(b) by 633 days.

(21) Appl. No.: 09/678,635

(22) Filed: Oct. 3, 2000

(51) Int. Cl.[7] ..... E06B 9/322
(52) U.S. Cl. ..... 160/178.1 V; 160/173 V
(58) Field of Search ..... 160/168.1 V, 173 V, 160/178.1 V; 292/300, DIG. 15, 23, 70; 16/86 R, 86 A

(56) References Cited

U.S. PATENT DOCUMENTS

| | | | | |
|---|---|---|---|---|
| 469,968 | A | * | 3/1892 | Frisbie |
| 1,340,252 | A | | 5/1920 | Rasmussen |
| 2,068,977 | A | | 1/1937 | Dodge |
| 2,145,666 | A | | 1/1939 | Rothel |
| 2,229,225 | A | | 1/1941 | Schneider |
| 2,419,486 | A | | 4/1947 | Dixon |
| 2,620,869 | A | | 12/1952 | Friedman |
| 2,807,322 | A | | 9/1957 | Toti |
| 2,885,237 | A | * | 5/1959 | Heyer |
| 3,038,534 | A | | 6/1962 | Clayton |
| 3,068,938 | A | | 12/1962 | Hull |
| 3,098,520 | A | | 7/1963 | Greenstadt |
| 3,107,947 | A | | 10/1963 | Hulerstrum |
| 3,135,369 | A | | 6/1964 | Niesenson |
| 3,208,507 | A | | 9/1965 | Breen |
| 3,231,847 | A | * | 1/1966 | Kressel |
| 3,299,943 | A | | 1/1967 | Poe |
| 3,307,663 | A | | 3/1967 | Luenberger |
| 3,340,975 | A | | 9/1967 | Erickson |
| 3,500,896 | A | | 3/1970 | Endou |
| 3,529,703 | A | | 9/1970 | Kroeker |
| 3,602,150 | A | | 8/1971 | Frost |
| 3,675,959 | A | * | 7/1972 | Hansen et al. |
| 3,708,827 | A | | 1/1973 | Foltz |
| 3,787,925 | A | | 1/1974 | Dawson |
| 3,915,268 | A | | 10/1975 | MacDonald |
| 3,920,106 | A | | 11/1975 | Nisenson |
| 3,951,076 | A | | 4/1976 | Knudsen |
| 4,103,727 | A | | 8/1978 | Spohr |
| 4,122,884 | A | | 10/1978 | Salzmann |
| 4,223,714 | A | | 9/1980 | Weinrich et al. |
| 4,254,813 | A | | 3/1981 | Vecchiarelli |
| 4,261,408 | A | | 4/1981 | Debs |
| 4,291,593 | A | | 9/1981 | Santambrogio |
| 4,291,738 | A | | 9/1981 | Grenga et al. |
| 4,293,021 | A | | 10/1981 | Arena |

(List continued on next page.)

FOREIGN PATENT DOCUMENTS

| | | |
|---|---|---|
| DE | 1698027 | 5/1955 |
| DE | 1803966 | 10/1968 |
| DE | 7129109 | 11/1971 |
| EP | 0562711 | 9/1993 |
| GB | 2031493 | 4/1980 |
| WO | WO 9324726 | 12/1993 |

*Primary Examiner*—Blair M. Johnson
(74) *Attorney, Agent, or Firm*—Curtis L. Harrington

(57) ABSTRACT

The system is applicable to any system having need for a positive stop at the end of a period of travel. In a vertical blind track system, a lead carrier which is typically manipulated by a control wand with universal linkage can include an installable and removable end stop engagement structure. This structure fits onto conventional lead carriers within a slot which is upwardly directed and at one side of the lead carrier. The installable and removable end stop engagement structure has a wide lateral slot, and including a first engagement member for engaging an edge of one end of the slot on the lead carrier, and a second engagement member which is angled and placed next to an extension to facilitate manual engagement and removal of the installable and removable end stop engagement structure. Once mounted in place, it aligns with, and is force or momentum inserted into and through a stop engagement aperture.

14 Claims, 3 Drawing Sheets

U.S. PATENT DOCUMENTS

| | | | | |
|---|---|---|---|---|
| 4,316,493 | A | | 2/1982 | Arena |
| 4,332,288 | A | | 6/1982 | Frentzel et al. |
| 4,372,432 | A | | 2/1983 | Waine et al. |
| 4,433,765 | A | | 2/1984 | Rude et al. |
| 4,449,564 | A | | 5/1984 | Hansen et al. |
| 4,519,435 | A | | 5/1985 | Stier |
| 4,557,159 | A | | 12/1985 | Gross |
| 4,622,422 | A | | 11/1986 | Anderson |
| 4,742,860 | A | | 5/1988 | Debs |
| 4,791,703 | A | | 12/1988 | Chang |
| 4,798,149 | A | | 1/1989 | Hoffmann |
| 4,818,590 | A | | 4/1989 | Prince et al. |
| 4,834,164 | A | | 5/1989 | Tuhey, Jr. |
| 4,844,139 | A | | 7/1989 | John |
| 4,846,249 | A | | 7/1989 | Cooper et al. |
| 4,869,309 | A | | 9/1989 | Evans |
| 4,919,185 | A | | 4/1990 | Comeau et al. |
| 4,921,031 | A | | 5/1990 | Wagner et al. |
| 5,119,871 | A | | 6/1992 | Schwaegerle |
| 5,121,785 | A | | 6/1992 | Ohsumi |
| 5,137,073 | A | | 8/1992 | Huang |
| 5,165,459 | A | | 11/1992 | Gaber et al. |
| 5,170,531 | A | | 12/1992 | Ryan |
| 5,297,608 | A | | 3/1994 | Rap et al. |
| 5,349,783 | A | | 9/1994 | Jasperson |
| D355,092 | S | | 2/1995 | Knuteson |
| 5,443,109 | A | | 8/1995 | Benthin |
| 5,445,205 | A | * | 8/1995 | Hansen |
| D366,174 | S | | 1/1996 | Swopes |
| 5,488,983 | A | | 2/1996 | Jung |
| 5,522,445 | A | | 6/1996 | Hoffman |
| 5,538,066 | A | | 7/1996 | Liu |
| 5,577,542 | A | | 11/1996 | Hung |
| 5,630,457 | A | | 5/1997 | Chou |
| 5,647,422 | A | | 7/1997 | Weng |
| 5,680,892 | A | | 10/1997 | Liu |
| 5,699,846 | A | | 12/1997 | Ohanesian |
| 5,848,632 | A | | 12/1998 | Chou |
| 5,875,829 | A | | 3/1999 | Chou |
| 5,937,928 | A | | 8/1999 | Chou |
| 5,983,972 | A | | 11/1999 | Chou |
| 5,992,495 | A | * | 11/1999 | Cadorette |
| 6,048,285 | A | | 4/2000 | Chou |
| 6,138,740 | A | | 10/2000 | Chou |

* cited by examiner

POSITIVE ENGAGEMENT END STOP FOR WINDOW COVERING SYSTEMS

FIELD OF THE INVENTION

The present invention relates to the field of window coverings and more particularly for improvements in stabilizing any window covering which moves within a track, particularly at the terminus of its travel to achieve complete closure, with completion of closure transmitted to the user and which permits operation of the control and at the point of complete closure without inadvertently dislodging the window covering from its fully closed position.

BACKGROUND OF THE INVENTION

The conventional vertical blind system includes a single length elongate track having a series of either vertical blind vane carrier supports or a series of hanging supports. Further discussion will be had mostly about vertical blinds, for although the structures discussed herein can be utilized with a series of types of window coverings, the case where a control want is used to move the window covering across the window as well as to affect some other aspect of control, especially as by turning the wand to change the angle of vertical louvers, or other applied characteristics of the state of the window covering.

One arrangement which was employed to affect a positive close was set forth in U.S. Pat. No. 5,937,928 to the inventor of the instant invention and was entitled "MULTIPLE PULL ROD MULTIPLE VANE POSITIVE CLOSE CONTROL FOR A VERTICAL BLIND", issued on Aug. 17, 2000, and is incorporated herein by reference. In this invention, a small magnet, typically having a cross or plus or (+) sectional shape was engaged into a lead carrier, especially where it was an end carrier, with the magnet engaging a metallic screw or rivet set located in a conventional end cap which was typically found at the end of a track supporting the carrier.

Factors affecting the performance of this arrangement includes the strength and positioning of the magnet, the compatibility of the metallic bolt with the end cap, as well as series of optional flat members which are used to support elongate structures within the track such as very long turning rods, etc. The system so disclosed not only provided some positive securing of the window cover, but provided up to three supporting flat members for cases where the track was long and where significantly long lengths of turning rod within the window covering and to prevent the sagging of and to support the turning rod. The use of the flat members also involved the use of an additional bolt in the carrier for engagement with a separate magnet in the flat member. As the flat members followed after the carrier, a series of placed screws in the head rail would engage upwardly projecting structures of the flat members and pick them away from the carrier one at a time to evenly distribute the flat members to support the turning rod.

The device thus outlined has the ability to perform closure at the center or ends of a window covering track. The employment of this structure required some alteration to the carrier, such as magnet insertion, bolt insertion for engaging the magnet of the flat member, often employing an additional flat member adjacent the end cap, and utilizing a two ended threaded rivet.

What is needed therefore is a system which can be more readily retrofitted onto existing carriers and window covering systems and which employs fewer parts. What is needed is a positive closure at the end of travel, coupled with an indication of such positive closure so that the user need not continue to try and insure that positive closure has occurred. In cases where the end of travel is against or adjacent a wall, non positive closure would cause the user to back the carrier up and again slide it with momentum against the end of the head rail.

Another concern is spacing adjacency from the end of the head rail. Where several flat members separate the end cap from the carrier, and especially where the carrier does not have some sort of carry around structure, a greater space is created between the carrier and the end cap which must be compensated for by a wall structure to shut out the light, or an extra covering louver behind which the carrier may be concealed. As such, a needed structure should allow the carrier to be fixed in as close a relation to the end cap as is possible, while giving the user a positive indication of fixation or lock, subject to the need for flat members to support an especially long internal turning rod. What is therefore also needed is a manner of forming positive closure in order that vertical blinds may be closed securely, exactly and precisely with regularity. The closure mechanism should be highly integratable with existing track systems and vertical blind carriers. The system may provide for a distributed system of support which will support any tendency of the rotation rod to sag. The system should provide positive feedback to the operator that the blinds are securely closed.

SUMMARY OF THE INVENTION

The improved system of the invention is applicable to any system having need for a positive stop at the end of a period of travel. In a vertical blind track system, a lead carrier which is typically manipulated by a control wand with universal linkage can include an installable and removable end stop engagement structure. The installable and removable end stop engagement structure fits onto conventional lead carriers within a slot which is upwardly directed and at one side of the lead carrier. The installable and removable end stop engagement structure has a wide lateral slot, and including a first engagement member for engaging an edge of one end of the slot on the lead carrier, and a second engagement member which is angled and placed next to an extension to facilitate manual engagement and removal of the installable and removable end stop engagement structure. Once mounted in place, and once an end cap for the head rail or sliding track is installed, the installable and removable end stop engagement structure has an expanded end which is force or momentum inserted into and through a stop engagement aperture. The expanded head has a split slot and the halves or other divided portions of the expanded head cantilever toward each other to enable the expanded head to clear the engagement aperture.

The system may be used with an optional flat support member 35 to help support a distributed control rod during the time that the lead carrier and single carriers are to one side. Multiple single carriers and multiple lead carriers may be utilized, especially at the ends of the head rail. The flat distributed position support member may follow the lead carrier by either magnetic force or by selective engagement with the installable and removable end stop engagement structure.

This system is further facilitated for use in existing structures by only having to by provide a locking member onto a conventional carrier, and providing an end cap having an aperture to permit friction and pressure locking of such locking member into the aperture.

The locking member has set offs which enable it to lock onto a carrier and achieve a constant spacing from the edge of the rail so as to align with an aperture provided in an end cap. The end cap typically has an oval depression, as is typical in the art, which provides a space for the tip end of the locking member to enter. The tip of the locking member has a split to allow two halves to cantilever toward each other. As the tip is momentum fed through the aperture by, the members on either side of the split move together so that the relatively larger diameter occupying areas of the member are guided through an associated aperture in the end cap and stop with a "snap" action.

The angle of the leading end of the tip as well as the angle aft of the maximum diameter occupying areas of the member defines the magnitude of momentum for both inertial insertion and force of disengagement. In the basic configuration, the invention may include simply an end cap with appropriate aperture, and the engagement member. The engagement member is provided as a single bullet shaped member having latch engagement members which over fit and engage the carrier. One or more side projections appropriately fit the spacing laterally with respect to the carrier to insure that the aperture in the end cap will be approached by the engagement member through its center. For both the left and right hand side approaches, the engagement member will be available in left and right side configurations.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
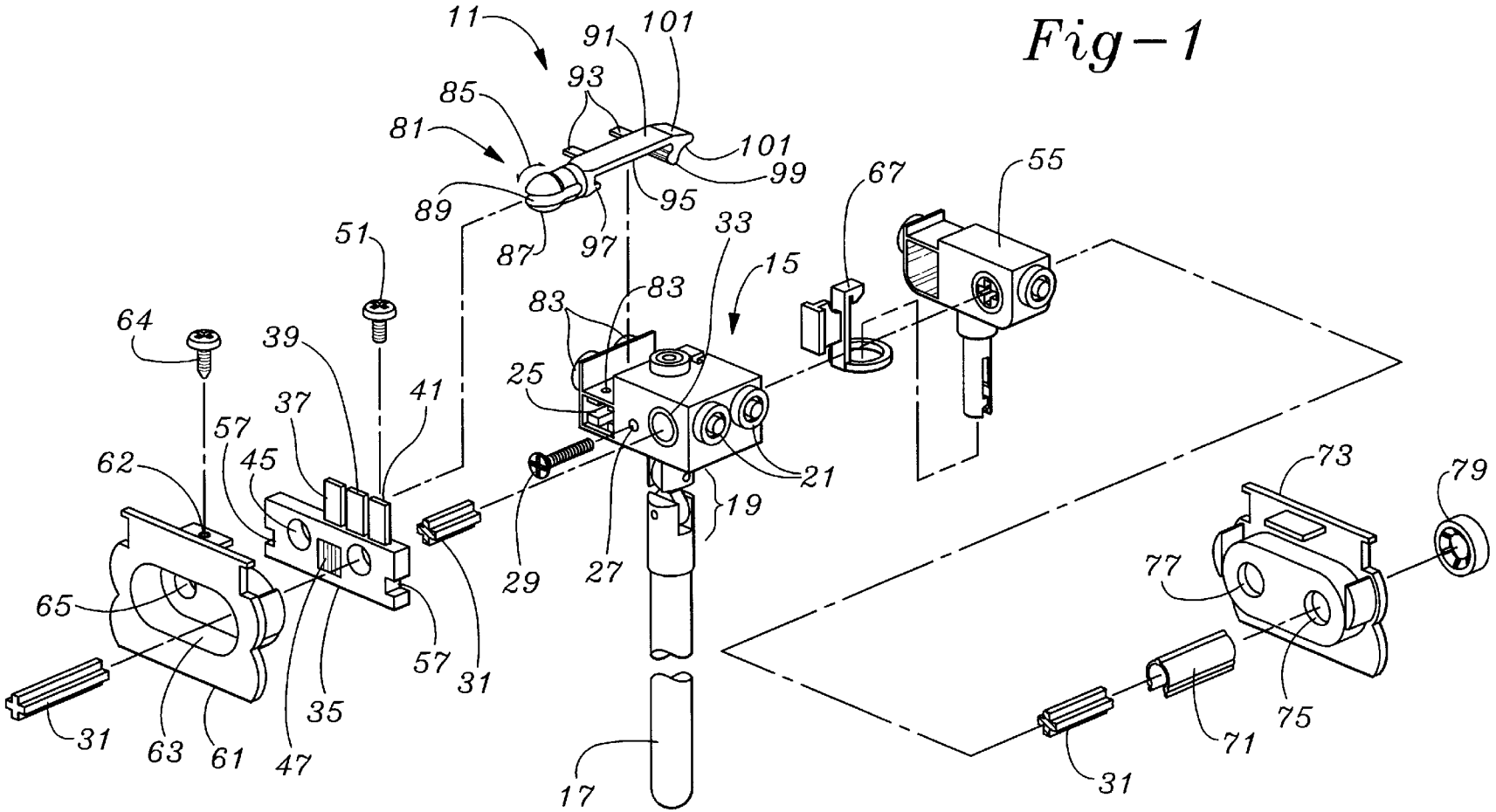
FIG. 1 is a distributed exploded view of the ordering of components of a vertical blind track system, with track removed, and illustrating the interrelationship of the components.

The description and operation of the invention will be best described with reference to FIG. 1 which is a distributed exploded view of the ordering of components of a vertical blind track system 11, with track removed, and illustrating the interrelationship of the components, including a lead carrier 15 having a control wand 17 connected into the lead carrier through a universal linkage 19. The carrier has two pairs of wheels including a first pair of mutually adjacent wheels 21 and a second pair of mutually adjacent wheels 23. The carrier 15 has a recessed cross shaped space 25 and an aperture or bore 27 for accepting an optional threaded member 29.

An in-track turning distributed control rod 31 is shown in short section as extending through a turn actuation sleeve 33 supported within the lead carrier 15. An optional flat support member 35 has a series of three upper projections 37,39, & 41, a rod accommodation bore 43, and a stop accommodation bore 45. In some cases, a magnet 47 is located within the flat support member 35 in order to engage with the threaded member 29 so that the flat support member 35 will travel along with the lead carrier 15 until one of the three upper projections 37, 39, & 41, engages a threaded member 51 shown suspended above the projection 41. The threaded member 51 is usually engaged into the top of the head rail (not shown) the tail of the threaded member 51 protruding downwardly to interfere with the projection 41 as it translates along the head rail, to cause it to become separated from the lead carrier 11 and where it can provide added support to the turning distributed control rod 31 when the lead carrier is drawn back against a series of single carriers 55 leaving extended portions of the turning distributed control rod 31 otherwise unsupported. Note that flat support member 35 has a pair of notches 57 which engage internally disposed track structures (not shown) in the head rail which enable a much more exacting degree of support. In long head rail applications, where the lengths of the control rod 31 left un-supported with be great, several of the flat support members 35 may be used, each with its own associated one of the series of three upper projections 37, 39, & 41 left standing in order to engage its associated threaded member 51.

Adjacent the flat support member 35 is the end cap 61 having an upper aperture 62 which is amenable to engagement by a threaded member or locking pin or any other structure which facilitates holding the end cap 61 in the head rail (not shown in FIG. 1). End cap 61 has a recessed area 63. Above the end cap 61 a threaded member 64 is seen and is of such length that combined with the thickness of the head rail and the distance between the top of the end cap 61 and the upper recessed area that the threaded member 64 will not penetrate the recessed area 63. End cap 61 also has an aperture through which turning distributed control rod 35 extends (not seen in FIG. 1), and a stop engagement aperture 65. The control rod 35 will be terminated in its extent within the recessed area, typically with a slide lock fitting, which helps hold the end cap onto the head rail (not shown).

To the other side of the lead carrier 15 and between lead carrier 15 and the single carrier 55 is shown a connector 67 which places the adjacent single carrier 55 in close relationship to the lead carrier 15. The next most adjacent structures seen include a turning distributed control rod 31 shown adjacent a spacer 71 and an end cap 73 which may be a mirror image of the end cap 61, and is shown with an aperture 75 through which turning distributed control rod 35 extends, and a stop engagement aperture 77. There is no lead carrier adjacent the end cap 73 although there may be in an actual installation. The configuration of FIG. 1 illustrates that the end caps 61, 73 are mirror images of each other unless their stop engagement apertures 77, 65 are the same size as their apertures, including aperture 75 through which turning distributed control rod 35 extends. If these apertures are the same size, a single configuration of end cap 61, 73 can be used. An end fitting 79 has a diameter greater than the aperture 75 and is for engaging the terminal end of the turning distributed control rod 31 and to better keep the end cap 73 in place with respect to the track (not seen in FIG. 1).

Above the lead carrier 15, an installable and removable end stop engagement structure 81 is seen. The lead carrier 15 has an upper through slot 83 into which the end stop engagement structure 81 fits. The end stop engagement structure 81 has a generally cylindrically shaped body having a general centerline which over fits the base of the through slot 83. At one end is a cylindrical extension 85 having an enlarged end 87 which is bifurcated by a slot 89 which allows the bifurcations to bend in a cantilevered fashion toward each other. Just past the enlarged end 87, the cylindrical extension 85 has a conical section which may have an increased diameter to facilitate engagement with any structure provided to form a stop structure to the installable and removable end stop engagement structure 81, especially where, for example a stop engagement aperture 65 has a matching diameter such that when the cylindrical extension 85 gets past the enlarged end 87, the cylindrical extension 85 conical section may be stopped by a solid conical engagement with an appropriately sized engagement aperture 65. This can permit several flat support members 35 to be engaged onto the cylindrical extension 85 which may easily clear the enlarged end 87 or not, as the case may be, but with a conic section just behind the enlarged end 87 which will stop the cylindrical extension 85 with regard to the engagement aperture 85.

The main body of the end stop engagement structure 81 has a flat top 91 from which a pair of side spacing protrusions 93 extend in order to insure that the position of the end stop engagement structure 81 within the slot 83 will be at a position close to the center of the lead carrier in order to pre-align with the stop engagement apertures 77, 65 of the end caps 61, 73.

The underside of the end stop engagement structure 81 includes a lateral slot 95 defined by a first projection 97 extending away from the cylindrical extension and for engaging the front corner of the base of the slot 83 recessed cross shaped space 25, and a second more rounded and/or more gently angled projection 99 for engaging the rear edge of the base of the slot 83. Projecting away from the end of the end stop engagement structure 81 opposite the cylindrical extension 85, is a lip 101 to facilitate manual attachment and detachment of the end stop engagement structure 81 into and out of the slot 83, especially facilitated by the combination of the size and shape of the second more rounded and/or more gently angled projection 99. In typical fashion, the first projection 97 will be placed around the lower end edge of the slot 83, and the second more rounded and/or more gently angled projection 99, which can be more easily engaged over its lower end edge of the slot 83 being snapped into place with downward pressure on the flat top 91 perhaps combined with some upward pressure on the lip 101. To remove the end stop engagement structure 81, the reverse action of providing upward pressure on the lip 101 perhaps with some downward pressure on the flat top 91.

The end stop engagement structure 81 could be made with a wider body, or the axis of its extent could be shifted, etc. However the side spacing protrusions enable the end stop engagement structure 81 to be advantageously located within the slot 83 to enable its engagement with the stop engagement apertures 65, 67.

Figure 2:
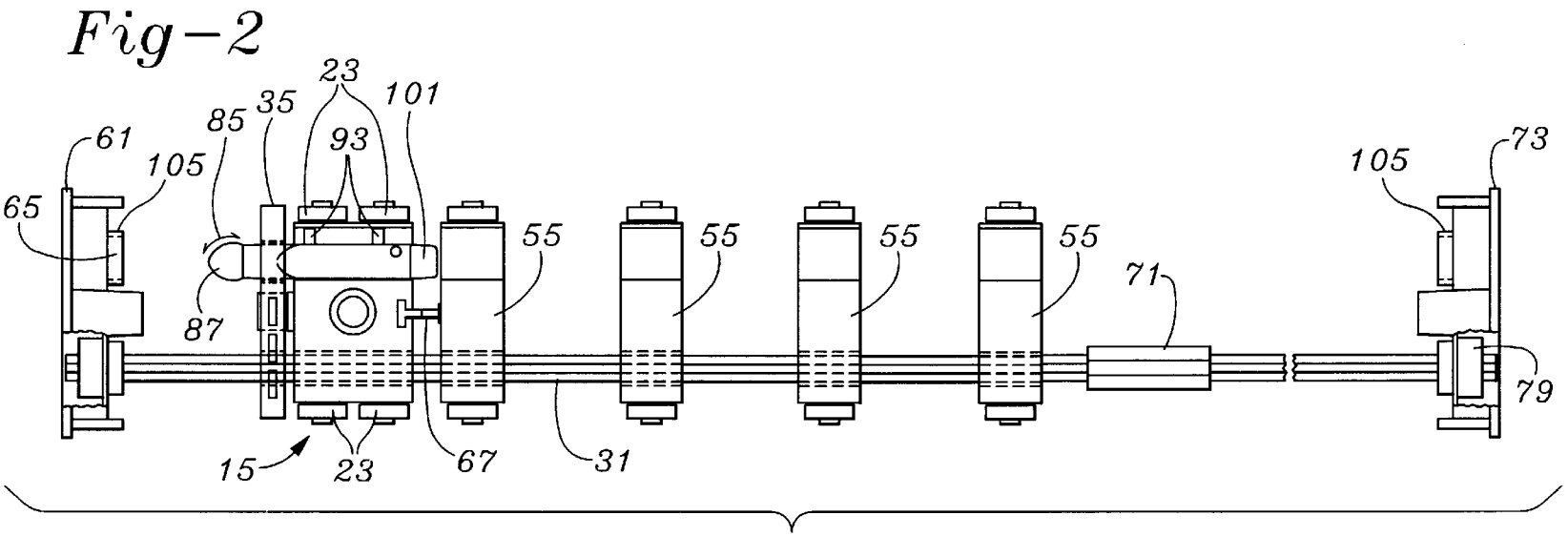
FIG. 2 is a top view which illustrates the cooperation of the components seen in FIG. 1.

Referring to FIG. 2, a top view shows more of the thickness detail of the end cap 61 may have a boss 105 surrounding the stop engagement aperture 65 and which may advantageously give control of the ability to insure that the engagement aperture 65 has a well defined and precisely determinable inner diameter. A well defined internal diameter will enable reproducible control of the force necessary to move the enlarged end 87 of the cylindrical extension 85 through the stop engagement aperture 65.

The flat support member 35 stop accommodation bore 45 is seen having the cylindrical extension 85 having passed through it. The interaction between the flat support member 35 stop accommodation bore 45 and the enlarged end 87 of the cylindrical extension 85 may range from complete non-interference to slight interference. Where the magnet 47 is not present, and a very slight interference, perhaps only a vertical interference, can be used to cause the flat support member 35 to follow the lead carrier 15 until separated by the threaded member 51. With slight and controllable interference, and perhaps only in one dimension, on the way back, the flat support member 35 would either be re-engaged by the cylindrical extension 85 at a position near the threaded member 51 after the cylindrical extension has reached the boss 105. Thus, the magnet 47 in combination with the threaded member 29 works well, but can, in some cases be eliminated. Recall also that the flat support member 35 is optional and only used where the extent of the control rod 31 is great such that it would be left to sag should the lead carrier 15 move the individual carriers 55 to one side. Where the flat support member 35 is not utilized, the shape of the cylindrical extension 85 may in any event be formed so that it will not overextend through the boss 105. Put another way, the limitation of passage through the boss 105 may be dependent upon the size and shape of the cylindrical extension 85. As can be seen in FIG. 2, the shape of the cylindrical extension 85 just past the enlarged end 87 is angled but of such size that the flat support member 35, with its stop accommodation bore 45, has passed over it. The diameter of the boss 105 may be so as to prevent further passage of the cylindrical extension 85. In most applications, the end cap 61 may also be bound by a wall or other structure, and it too may act as an ultimate stop for the extent to which cylindrical extension 85 extends through the boss 105, but preferably not. A break is shown in FIG. 2 to illustrate that the system 11 may not necessarily consist of a single slide with one lead carrier 15, but may consist of a system 11 having two lead carriers 15, one at each end.

Figure 3:
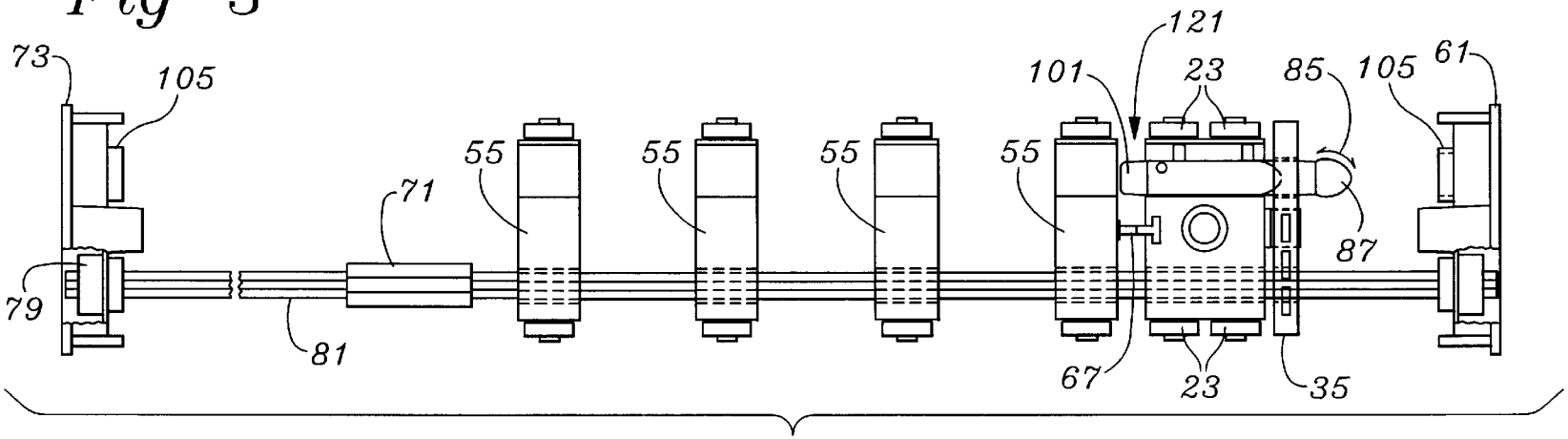
FIG. 3 is a top view similar to that seen in FIG. 2 and illustrating the interfitting ability of the assembly on an opposite end, that a mirror configured stop is utilizable.

FIG. 3 helps to illustrate this. If the breaks in FIG. 2 and FIG. 3 are considered to be such that the shorter ends are gone and what remains is part of complete system. A two lead carrier 15 system 11 results, but the other lead carrier 115 seen in FIG. 3 is a mirror image of the lead carrier 15 of FIGS. 1 & 2. Aside from the mirror image carrier configuration of lead carrier 115, the carrier itself may be such that it is reversible and is exactly the same as carrier 15. However, even where this is so, the installable and removable end stop engagement structure 81 cannot be merely reversed as it would cause the pair of side spacing protrusions 93 to project toward the center of the carrier 115 and thus cause the centerline or center axis (running roughly through the slot 89 of the enlarged end 87 and through the gently angled projection 99) to move farther outboard of the carrier 115. Thus carrier 115 utilizes a structure which is a mirror image to the installable and removable end stop engagement structure 81, namely, a the installable and removable end stop engagement structure 121. Aside from the mirror structure, other smaller aspects of the structures seen in FIG. 3 are the same as structures of FIGS. 1 & 2.

Figure 5:
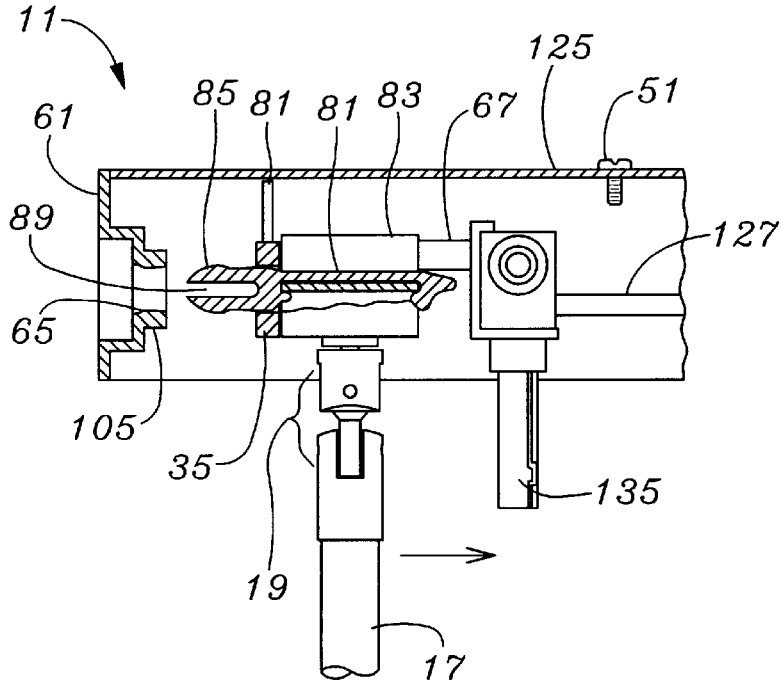
FIG. 5 is a side view as seen in FIG. 4 and illustrating full engagement of the stop into the end cap.

Referring to FIG. 5, a side sectional view of a head rail 125 having a wheel track 127 illustrates the lead carrier with the the installable and removable end stop engagement structure 81 penetrating both the stop engagement aperture 65 of the end cap 61 as well as the stop accommodation bore 45 of the flat support member 35.

Figure 4:
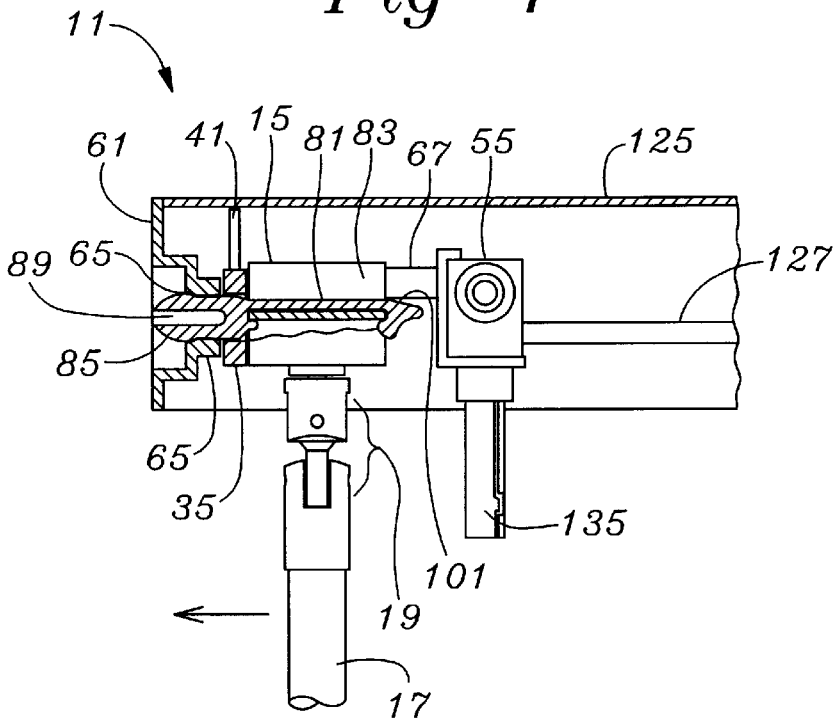
FIG. 4 is a side view which illustrates the action of the engaging stop before engagement.

FIG. 5 illustrates a view from the same perspective as that seen in FIG. 4, but with the the installable and removable end stop engagement structure 81 having been just disengaged from the stop engagement aperture 41, but still carrying the flat support member 35 along with it. The operation is such that an operator urges lead carrier 15 toward the end cap 61 with enough force that the the installable and removable end stop engagement structure 81 cylindrical extension 85 enlarged end 87 extends through accommodation bore 65 and engages it to provide some force threshold which must be broken to remove the lead carrier 15 to travel in the other direction. While this positive end stop or temporary capture is in effect, the user can rotate the wand 17 to cause the vertical blind holders 135 to rotate without otherwise having to apply force to the lead carrier to hold the lead carrier in closed position. This translates to much less force which otherwise has to be applied to the wand 17. The snap-stop action also lets the user know at what point the system 11 is completely closed to the full extent. In this way the user does not have to continually keep closing the vertical blind arrangement. When the user wants to open the vertical blinds by causing the carriers 55 to be collected at the other end, only enough initial pulling force need be applied to free the lead carrier 15, and the relatively friction free wheels, such as wheels sets 21 and 23, enable the user to very easily open and thereafter close the series of vertical blinds associated with the carrier.

While the present invention has been described in terms of a positive end stop system which can be utilized in both vertical blind and other window covering systems, both with and without a magnetic assist on a support member, one skilled in the art will realize that the structure and techniques of the present invention can be applied to many similar appliances. The present invention may be applied in any situation where positive end hold is desired, as well quick release operation.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A system for providing a positive stop for a carrier in a window covering system with respect to an anchoring structure comprising:

an anchoring structure for being supported along a path of travel of a lead carrier for a window covering mechanism;

an engagement structure having an extension having a first end with an enlarged portion and a second end, said engagement structure for attachment to said lead carrier such that said first end is alignable with an engagement aperture in said anchoring structure to cause said enlarged portion of said first end of said engagement structure to be at least one of momentum and force engageable with said engagement aperture to hold said lead carrier in place to facilitate the manual operation of control structures supported by said lead carrier, and wherein said engagement structure has a main axis extending between said first and second ends and a lateral side spacing protrusion for setting the lateral interfit position of said engagement structure with respect to said lead carrier.

2. The system as recited in claim 1 wherein said engagement structure includes a first projection located nearer said first end than said second end and a second projection located nearer said second end said second projection angled to facilitate locating said engagement structure onto said lead carrier.

3. The system as recited in claim 2 wherein said engagement structure includes a lip at least one of adjacent and forming said second end of said engagement structure.

4. The system as recited in claim 1 wherein said anchoring structure is an end cap.

5. The system as recited in claim 4 wherein said enlarged portion of said first end of said engagement structure includes a slot dividing it into a plurality of portions, said plurality of portions urgeable toward each other when said enlarged portion is passed through said engagement aperture of said end cap.

6. The system as recited in claim 1 wherein said engagement aperture includes a boss directed toward said engagement structure.

7. A system for providing a positive stop for a carrier in a window covering system with respect to an anchoring structure comprising;

an anchoring structure for being supported along a path of travel of a lead carrier for a window covering mechanism;

an engagement structure having an extension having a first end with an enlarged portion and a second end, said engagement structure for attachment to said lead carrier such that said first end is alignable with an engagement aperture in said anchoring structure to cause said enlarged portion of said first end of said engagement structure to be at least one of momentum and force engageable with said engagement aperture to hold said lead carrier in place to facilitate the manual operation of control structures supported by said lead carrier, and wherein said engagement structure extension has a conical portion aft of said enlarged portion and sized to stoppingly engage said engagement aperture.

8. A system for providing a positive stop for a carrier in a window covering system with respect to an anchoring structure comprising:

an anchoring structure for being supported along a path of travel of a lead carrier for a window covering mechanism;

an engagement structure having an extension having a first end with an enlarged portion and a second end, said engagement structure for attachment to said lead carrier such that said first end is alignable with an engagement aperture in said anchoring structure to cause said enlarged portion of said first end of said engagement structure to be at least one of momentum and force engageable with said engagement aperture to hold said lead carrier in place to facilitate the manual operation of control structures supported by said lead carrier; and a support member having a stop accommodation bore through and beyond which said extension may pass in order to engage said engagement aperture.

9. An engagement structure comprising an extension having a first end with an enlarged portion and a second end, said engagement structure having a lateral slot for fitting over an upper through slot of a lead carrier of a window covering mechanism in a position is alignable with an engagement aperture carried by said window covering mechanism for enabling said engagement structure to be at least one of momentum and force engageable to hold said lead carrier in place to further facilitate the manual operation of control structures supported by said lead carrier.

10. The engagement structure as recited in claim 9, wherein said engagement structure has a main axis extending between said first and second ends and a lateral side spacing protrusion for setting the lateral interfit position of said engagement structure with respect to said upper through slot of said lead carrier.

11. The engagement structure as recited in claim 9 wherein said engagement structure includes a first projection located nearer said first end than said second end and a second projection located nearer said second end said second projection angled to facilitate locating said engagement structure onto said upper through slot of said lead carrier.

12. The engagement structure as recited in claim 11 wherein said engagement structure includes a lip at least one of adjacent and forming said second end of said engagement structure.

13. The engagement structure as recited in claim 9 wherein said enlarged portion of said first end of said engagement structure includes a slot dividing it into a plurality of portions, said plurality of portions urgeable toward each other when said enlarged portion is passed through said engagement aperture.

14. The engagement structure as recited in claim 9 wherein said engagement structure extension has a conical portion aft of said enlarged portion and sized to stopingly engage said engagement aperture.

* * * * *